United States Patent [19]

Terry

[11] 4,010,800

[45] Mar. 8, 1977

[54] PRODUCING THIN SEAMS OF COAL IN SITU

[75] Inventor: Ruel C. Terry, Denver, Colo.

[73] Assignee: In Situ Technology, Inc., Denver, Colo.

[22] Filed: Mar. 8, 1976

[21] Appl. No.: 664,570

[52] U.S. Cl. ..... 166/258; 166/272; 48/210; 48/DIG. 6

[51] Int. Cl.[2] ..... E21B 43/24

[58] Field of Search ..... 166/258, 257, 256, 261, 166/262, 269, 272; 299/2; 48/210, DIG. 6

[56] References Cited

UNITED STATES PATENTS

| | | | |
|---|---|---|---|
| 2,584,605 | 2/1952 | Merriam et al. | 166/257 |
| 3,072,187 | 1/1963 | Carr | 166/258 |
| 3,163,215 | 12/1964 | Stratton | 166/258 X |
| 3,548,938 | 12/1970 | Parker | 166/256 |
| 3,599,714 | 9/1969 | Messman et al. | 166/258 |
| 3,661,423 | 5/1972 | Garret | 299/13 X |
| 3,809,159 | 5/1974 | Young et al. | 166/258 |
| 3,924,680 | 12/1975 | Terry | 166/258 |
| 3,952,802 | 4/1976 | Terry | 166/261 X |

*Primary Examiner*—Stephen J. Novosad
*Attorney, Agent, or Firm*—Gary M. Polumbus

[57] ABSTRACT

A method of extracting energy and chemical values from coal in situ including the steps of establishing passages among two or more coal seams underground and the surface of the ground wherein one coal seam is consumed by in situ combustion with the hot exit gases diverted through a second seam of coal enroute to the surface. The second seam of coal is dewatered, then subjected to pyrolysis, with enriched exit gases captured at the surface.

5 Claims, 3 Drawing Figures

PRODUCING THIN SEAMS OF COAL IN SITU

BACKGROUND OF THE INVENTION

Generally the composition and characteristics of coal can be described as relative amounts of moisture, volatiles, fixed carbon and ash. In describing coal the industry has standardized on data from basic tests and procedures. For example, the moisture content of coal is determined by subjecting the coal as received to heat under standard conditions with the temperature maintained slightly above the boiling point of water. This procedure results in drying of the coal and a resultant loss of weight which is readily measurable. This simple test provides a reasonably accurate measure of water entrained in the coal, although it is recognized that further heating at higher temperature could result in the expulsion of greater amounts of moisture. Likewise, the industry has standardized on tests and procedures for determining the volatile content of coal. After drying the coal to determine moisture content as described above, the dried coal is placed in a closed container where it is heated for a specific time, for example 7 minutes at an elevated temperature, for example 950° C (1742° F). Thus the volatile matter in coal can be determined by measuring the loss in weight, although it is recognized that the amount of volatile matter given up by the coal would change should the length of heating time be changed, the temperature be changed, or both. Further the standard tests may be continued by taking the residual solid material and burning it under standard conditions to a final residual or ash. Then by adding up the relative amounts of moisture, volatiles and ash expressed as percentages and subtracting the total from 100, the relative amount of fixed carbon can be computed.

The volatile matter in coal is not truly volatile in the strictest sense, but rather volatiles are a result of decomposition of the coal when subjected to heat. Volatiles extracted from coal include for the most part combustible gases, with smaller amounts of non-combustible gases. Among the combustibles are numerous hydrocarbons (including methane), hydrogen, carbon monoxide and the like. Non-combustibles generally are water vapor, carbon dioxide and the like. Further, it is quite common to find combustible gases entrained in the coal apart from the so called volatiles. Many coal deposits have large quantities of entrained combustible gases, commonly called "fire damp," the principal constituent of which is methane. In this regard it is not uncommon among coal deposits in the United States to find coal beds that contain in the order to 100 standard cubic feet of methane entrained in each ton of coal in place. Methane entrained in coal compares favorably to natural gas of petroleum origin and may be recovered, in part, from coal by the simple expedient of drilling a well from the surface of the ground into the coal deposit. While methane may be recovered from coal in this manner, rarely is it commercially attractive to do so because the methane in coal is under moderate pressure compared to methane of petroleum origin, and the resultant flow rates to the well bore are quite low, the captured gas at the surface must be compressed in order to be moved by pipeline, and the like. Methane entrained in coal cannot be removed entirely by pressure differential without introducing another fluid to displace the methane.

In the coal bearing regions of the world it is quite common to find multibedded coal deposits in which in vertical sequence and in descending order there is the overburden, then a bed of coal, then a layer of sedimentary rock, then a bed of coal, then a layer of sedimentary rock, then a bed of coal, and so on. In some cases the various beds of coals may be separated by only a short distance such as 1 to 5 feet. In other cases the beds of coal may be separated by greater distances, for example 50 to 300 feet. Generally one bed of the sequence is of particular interest because of its areal extent, the quality of the coal, its bed thickness and the like. Nearby beds may not be of commercial interest because the seam is too thin for standard mining equipment, the coal contains too much debris, and similar factors. In these cases the beds of commercial interest are produced by conventional mining methods while nearby beds of coal remain untouched because the cost of extraction exceeds the market value of recovered coal.

Looking to newer methods of producing coal and in particular to the gasification of coal in situ, economic evaluation of a multibedded coal deposit also is required before production begins. As in the case of conventional mining of coal, thickness of the coal bed is a critical consideration. Factors that are detrimental to conventional mining of coal — increasingly thickening overburdens, high moisture contents, high ash contents, high firedamp contents, and the like — often are advantages to production of coal in situ by gasification. Generally, coal beds that are of the proper thickness for conventional mining are also of acceptable thickness for in situ gasification. Coal beds that are too thin for conventional mining, generally also are too thin for in situ gasification. Thus thin beds of coal remain unproduced when they overlie or underlie coal beds that are being produced by methods heretofore known.

OBJECTS OF THE INVENTION

It is an object of the present invention to provide new and improved processes for removing coal chemicals and energy values from coal in situ, with particular emphasis on coal seams considered too thin for recovery by conventional means.

It is an object of the present invention to provide new and improved processes for removing the moisture from coal as a preparation step for subsequent production processes.

Other objects of the invention will be apparent to those skilled in the art upon examination of the disclosure contained herein.

SUMMARY OF THE INVENTION

The methods taught herein may be applied to coal of any rank, but for illustrative purposes the description is directed to coals of subbituminous and lignite ranks. Typical analyses of a coal from Wyoming and a lignite from Texas are shown below on an as received basis and with moisture removed:

| Analysis Weight% | Lignite | | Coal | |
|---|---|---|---|---|
| | as received | free moisture | as received | free moisture |
| moisture | 24.75 | 0 | 9.51 | 0 |
| volatile matter | 33.52 | 44.55 | 32.64 | 36.07 |
| fixed carbon | 30.34 | 40.31 | 34.09 | 37.67 |

-continued

| Analysis Weight% | Lignite as received | Lignite free moisture | Coal as received | Coal free moisture |
|---|---|---|---|---|
| ash | 11.39 | 15.54 | 23.76 | 26.26 |

Generally the moisture and ash contents of coal are considered to be nuisances while the volatile matter and fixed carbons are considered to be useful components. Referring to the analysis table above it can be seen that removal of the moisture content from the lignite results in the removal of approximately one-fourth of the weight. On a volume basis, since water has a lower specific gravity than the fixed carbon and the ash, removal of the moisture content results in the removal of greater than one fourth of the original volume. Thus it is easy to envision that with removal of moisture from the lignite in situ, a considerable amount of porosity and permeability will be opened for the free passage of gases that can be made to migrate under the influence of differential pressure. Likewise, removal of moisture content of the coal will result in opening a considerable amount of porosity and permeability for the passage of gases.

Referring again to the analysis table above and disregarding the second nuisance, ash, it may be seen that of the useful components of lignite, more than half is composed of volatile matter, while for the coal almost half of the useful components is volatile matter. Thus it is easy to envision that once the moisture content is removed from either the lignite or the coal in situ, approximately one half of the useful components can be produced as voltatiles simply by the application of heat together with the differential pressure required to evacuate the volatiles to the surface.

The heat required to remove the moisture from coal of various ranks can be generated in one of the beds of a multibedded coal deposit by following the teachings of my copending patent application Ser. No. 531,453, filed Dec. 11, 1974, and now U.S. Pat. No. 3,952,802, which discloses methods of gasifying coal in situ. The hot exit gases generated can be diverted to another bed of coal in the multibedded deposit, thus providing the heat needed to remove moisture from the bed and the differential pressure required to remove the moisture to the surface of the ground. A continuing diversion of the hot exit gases into the second bed of coal provides heat required to release the volatile matter into the fluidized volatiles and the differential pressure to remove the volatiles to the surface of the ground for capture and commercial use.

One of the problems in gasifying coal in situ is controlling the burning of coal to a reducing environment so that the exit gases contain a reasonable amount of combustible gas. When the coal burning underground is affected by excessive oxygen such as occurs in oxygen injection bypass, the burning environment shifts from a reducing mode to an oxidizing mode and the combustible gases are substantially consumed in the fire. The exit gases then contain virtually no combustible gases and are commercially useful only for the sensible heat they carry. If the in situ gasification project is being conducted for the primary purpose of generating combustible gases and a well cannot be controlled to a reducing environment, there is little recourse but to abandon the well long before it has produced the coal reserves within its area of influence. Such premature abandonment is costly and unnecessary when reviewed in the light of the instant invention.

DESCRIPTION OF THE PREFERRED EMBODIMENT

Figure 1:
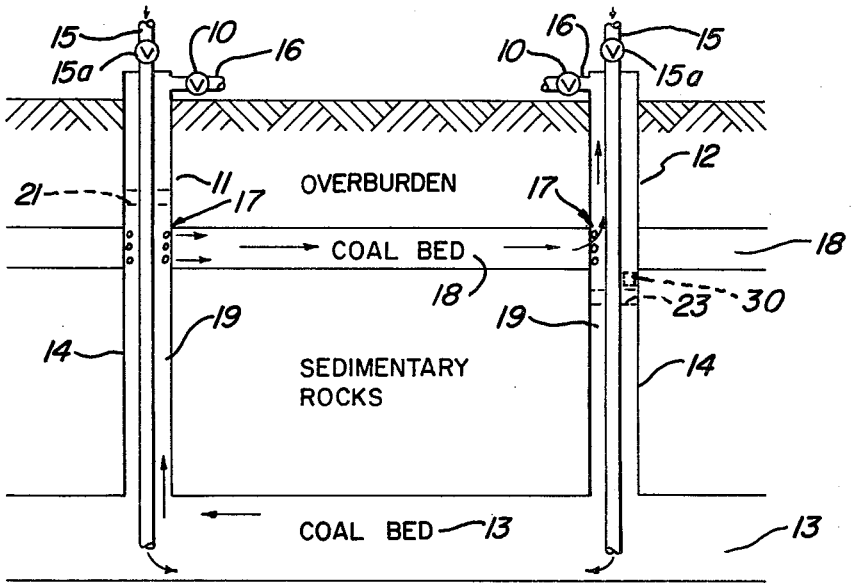
FIG. 1 is a diagrammatic vertical section taken through a portion of the earth illustrating the geological relationship of the coal zone that serves as a course of hot gases and another coal zone that is being produced using the method of the present invention.

Referring first to FIG. 1 a geologic condition ideal for practicing the method of the present invention is illustrated. In the ideal situation each of the coal strata would be "dry," that is, neither of the coal strata is an aquifier but both coal strata or beds contain coal with a moisture content typical of coal at its particular point in the natural coalification process. (Coals at two different points in the coalification process are illustrated by the Texas lignite and the Wyoming coal listed in the aforementioned table). Wells 11 and 12 are drilled to the bottom of the lowermost bed of coal 13. The wells are lined with protective casings 14 which are hermetically sealed by cementing in place. Oxidizer injection lines 15 are set inside the casings 14 with the lowermost part of the injection lines 15 positioned in the coal bed 13. Gas removal exits 16 are installed in the well heads and the system is hermetically sealed. The well casings 14 are perforated at a point 17 opposite the uppermost coal bed 18 using techniques common in the petroleum industry. Initially the perforations 17 may be hermetically sealed by setting a packer (not shown) in the well in alignment with the perforations. In commercial practice a multiplicity of wells would be drilled and equipped such as illustrated by wells 11 and 12. It will be noted that wells 11 and 12 can serve as oxidizer injection wells or as gas removal wells or both.

The lower coal bed 13 is ignited and in situ gasification begins using a method such as taught in my copending patent application Ser. No. 531,453, filed Dec. 11, 1974, now U.S. Pat. No. 3,952,802, which is incorporated herein by reference. Initially the products of combustion may be removed through the annulus 19 of well 11 and through gas exit outlet 16 or as an alternate in a similar manner through well 12. After combustion is fully established in coal bed 13, for example when the exit gases reach a temperature of 2000° F, well 11 is converted into a hot gas injection well that feeds hot gases into coal bed 18. In converting well 11, the packer which may have been set to seal perforations at 17 is removed, gas exit line 16 is closed with a valve 10 and a packer 21 is set immediately above the perforations at 17 making a gas tight plug in the annulus 19. The use of a packer immediately above the perforations may not be necessary in all instances since closure of valve 10 would normally force exit gases emanating from the lowermost coal bed 13 to pass through the perforations into the uppermost coal bed 18 as desired. The packer which may have been set to seal the perforations at 17 in well 12 is removed and a packer 23 is set immediately below the perforations 17 in well 12 to provide a gas tight seal in the annulus 19 of well 12.

Preferably, oxidizer injection is terminated in well 11 by closing a valve 15*a* in the oxidizer injection tubing 15. Oxidizer injection continues in well 12 through oxidizer injection tubing 15 of well 12 in order to sustain in situ gasification of coal bed 13. The normal pressure of coal bed 18, for example 150 psig, is greatly exceeded by the in situ gasification pressure in coal bed 13, for example 500 psig. The pressure in the coal gasification zone of coal bed 13 may be regulated by controlling the oxidizer injection pressure in concert with controlling the pressure in exit conduits to the surface.

Initially the coal in bed 18 and its entrained fluids may be relatively cool, for example 70° F. The hot gases from the in situ gasification zone of coal bed 13, under the influence of differential pressure, proceed upward through the annulus 19 of well 11, through the perforations at 17 in well 11 and into coal bed 18. The hot gases will proceed, under the influence of differential pressure, through the porosity and permeability of coal bed 18, to a lower pressure area such as is found in the annulus 19 of well 12. As the hot exit gases migrate through coal bed 18, some of the sensible heat is released causing a portion of the moisture in coal bed 18 to evaporate and be carried as water vapor in the migrating gases. Release of heat from the hot exit gases to the coal formation in coal bed 18, raises the temperature of the coal, and when the temperature of the coal exceeds the boiling point of water, moisture content of the coal will be expelled as steam which is removed along with the migrating gases through the annulus 19 of well 12. Also when the hot exit gases first encroach into coal bed 18, entrained gases in coal bed 18, such as fire damp, are moved by displacement and differential pressure into the annulus 19 of well 12 and on to the surface. Thus the hot exit gases which may be combustible with a calorific content of, for example 90 BTU per standard cubic foot are enriched by mixing with entrained gases such as fire damp which could have a calorific content of, for example, 950 BTU per standard cubic foot.

The process is continued by diverting hot exit gases from coal bed 13 first through well 11 into coal bed 18 and then through well 12 to surface facilities. The temperature of the coal in coal bed 18 is gradually increased and at approximately 300° C (572° F) some of the volatile matter is given up in the form of gases which further serve to enrich the calorific content of the exit gases. At this temperature a considerable amount of the volatile matter can become liquid as oozing tars which will tend to sink under the influence of gravity and to migrate under the influence of differential pressure. Such movement of coal derived liquids tends to plug the permeability in the lower portion of coal bed 18, resulting in gas flow tending to be greater in the upper portion of coal bed 18. If coal bed 18 is a thin bed, for example up to 18 inchess thick, gas override generally is not a problem. If coal bed 18 is a thicker bed, for example in excess of 18 inches thick, excessive gas override may occur, resulting in poor transfer of heat from the hot exit gases to the coal in the lower portion of coal bed 18. This condition can be corrected by terminating oxidizer injection temporarily into well 12, reducing pressure in the system, injecting a thermosetting sealant material (i.e., cement) into the annulus of well 12 so that it flows into the excessively permeable upper portion of the coal bed 18, subsequently displacing the sealant from the annulus 19 of well 12 by a suitable fluid, for example water, and then allowing the sealant to set in the coal bed 18. Upon setting of the sealant, the process of pyrolysis as described above may be resumed.

When the hot exit gases from coal bed 13 contain a substantial amount of combustible gases, for example 150 BUT per standard cubic foot, and it is desired to increase the temperature of the exit gases, appropriate oxidizer injection may be resumed through the oxidizer injection tubing 15 of well 12 at an appropriate pressure, for example 510 psig. This planned oxygen bypass will cause a portion of the combustible gases to burn, raising the temperature of the exit gases flowing into annulus 19 of well 11, and thus delivering hotter gases into coal bed 18, accelerating the rate at which volatile matter in coal bed 18 is converted into fluid volatiles.

The method of the present invention is continued until substantially all of the volatile matter contained in coal bed 18 is coverted to fluid matter and captured at the surface or until the recovery of volatiles from coal bed 18 is reduced to a level which makes it no longer commercially attractive to continue the process. In some cases a substantial amount of volatile matter in the form of coal derived liquids may migrate to the annulus 19 of well 12. The likelihood of this occurring may be predicted by taking samples of the coal in coal bed 18 when wells 11 and 12 are drilled through coal bed 18. An analysis of the coal can determine the characteristics of the volatile matter and its content of tars that become flowable liquids at relatively low temperatures. When excessive liquids are anticipated, the packer set below the perforations at 17 in well 12 should be set at a lower level to form a sump below the perforations, and a liquid pumping device 30 should be set in the annulus to remove the liquids from the sump to the surface.

The gases produced in the present invention may be used completely as fuel gases, or they may be used in part as fuel gases with the remainder of the useful gases separated as coal derived chemicals in appropriate surface facilities. Likewise the liquids produced in the present invention may be separated into coal derived chemicals, or in part into coal derived chemicals and the remainder into fuel gases.

As an alternate embodiment, the process described in the present invention as it applies to coal bed 18 may be terminated when a substantial amount of moisture content is removed from coal bed 18. This is particularly desirable when coal bed 18 is a thicker bed, for example 8 feet thick, and it is planned that coal bed 18 will be gasified as the appropriately commercial process to produce the coal. In some cases it may be desirable to use the method of the present invention to remove gases entrained in the coal, for example fire damp, when the production of coal from coal bed 18 is planned for conventional underground mining techniques.

Figure 2:
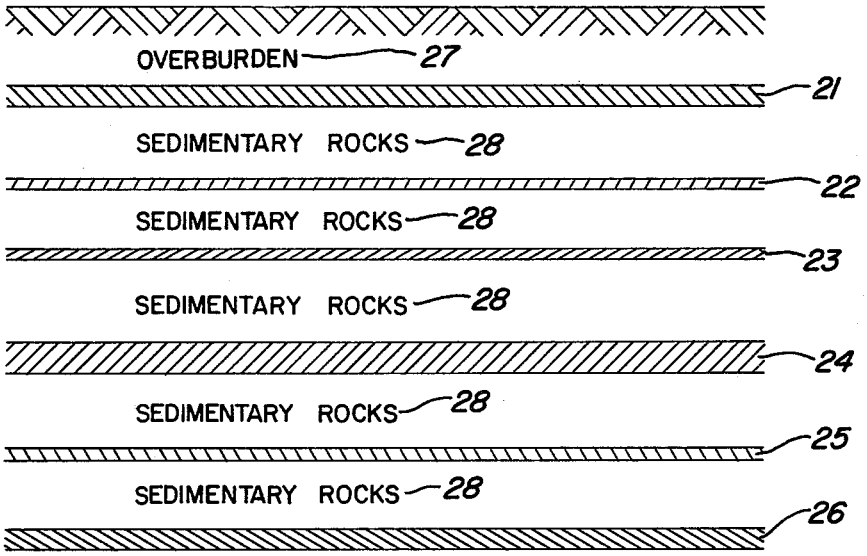
FIG. 2 is a diagrammatic vertical section taken through a portion of the earth showing a typical geological setting of a multibedded coal deposit.

Referring to FIG. 1 only two coal beds are illustrated. Referring to FIG. 2 where a larger number of coal beds are illustrated, some of them may be quite far apart, for example 200 feet, from the nearest adjacent bed. Those skilled in the art will readily envision that coal bed 24, overlain and underlain by sedimentary rocks 28, may be produced by in situ gasification with coal bed 26 produced by the methods of the present invention. When coal bed 26 is produced to its economic limit, the perforations opposite coal bed 26 are sealed off, using techniques common in the petroleum industry, then perforations are added opposite coal bed 25 and the methods of the present invention are used to produce coal bed 25 to its economic limit. The perforations opposite coal bed 25 are sealed off and perforations are added opposite coal bed 23, then coal bed 22, and so on. Since coal bed 21, overlain by the overburden 27, is near the surface, it may be desirable to follow the method of the alternate embodiment of the present invention to drive out the fire damp and remove a substantial amount of the moisture content in preparation of coal bed 21 for conventional underground mining. In proceeding with mining coal bed 21 by conventional underground mining techniques, the mining plan, for example, could be by the room and pillar method wherein the wells used in the present invention would be contained in the pillars.

Figure 3:
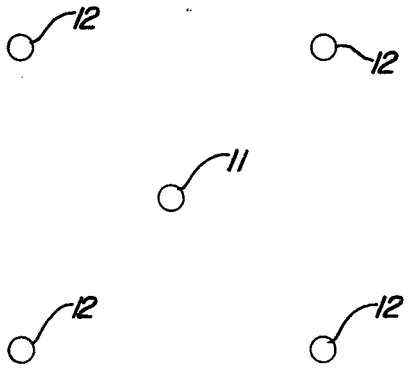
FIG. 3 is a diagrammatic plan view of a possible well pattern for use in practicing the method of the present invention.

Referring to FIG. 3, a well pattern which would be useful in producing a given area is illustrated. As will be appreciated, the lowermost coal bed 18 would be gasified by injection of an oxidizer through the four spaced wells 12 which surround well 11 and the hot gases released from the gasified bed 18 would be dispensed radially through the perforations at 17 in well 11 wherefrom the gases would flow outwardly through coal bed 13 for collection in the wells 12.

Although the present invention has been described with a certain degree of particularity, it is understood that the present disclosure has been made by way of example and that changes in details of structure may be made without departing from the spirit thereof.

I claim:

1. A method of extracting energy and chemical values from coal in situ wherein there are first and second subsurface coal beds separated by other subsurface material, comprising the steps of, establishing passages interconnecting the first and second coal beds and connecting the coal beds to a surface location, raising the pressure in the second coal bed to above its normal formation pressure, igniting the second coal bed to establish in situ gasification thereof, capturing hot gases resulting from the gasification of the second coal bed and directing the hot exit gases to and through the first coal bed to remove volatile material from the first coal bed, capturing the hot gases and entrained volatiles emanating from the first coal bed, and transferring the hot gases and entrained volatiles to the surface.

2. The method of claim 1 further including the step of placing control means in one of said passages for controlling hot exit gases from the second coal bed and causing the gases to flow into the first coal bed.

3. The method of claim 1 further including the steps of establishing a plurality of additional passages connecting the first coal bed to surface locations, said additional passages being spaced around said first passage, collecting in said additional passages hot gases and entrained volatiles flowing through the first coal bed, and transferring hot gases and entrained volatiles to the surface through the additional passages.

4. A method of extracting energy and chemical values from coal in situ wherein there are first and second subsurface coal beds separated by other subsurface material, comprising the steps of, establishing passages interconnecting the first and second coal beds and connecting at least said second coal bed to a surface location, igniting the second coal bed to establish in situ gasification thereof, capturing hot exit gases resulting from the gasification of the second coal bed and directing the hot exit gases to and through the first coal bed to remove volatile material from the first coal bed, injecting a sealant material into portions of the first coal bed after volatiles have been removed therefrom whereby the hot gases flowing through the first coal bed will follow alternate paths through the first coal bed, capturing the hot gases and entrained volatiles emanating from the first coal bed, and transferring the hot gases and entrained volatiles to the surface.

5. A method of extracting energy and chemical values from coal in situ wherein there are first and second subsurface coal beds separated by other subsurface material, and wherein the second coal bed lies below the first coal bed, comprising the steps of:

establishing passages interconnecting the first and second coal beds and connecting at least the second coal bed to a surface location, igniting the second coal bed to establish in situ gasification thereof, placing oxidizer injection tubing in said passage connecting the surface location with the second coal bed to sustain gasification thereof, placing blocking means in all but one of said passages interconnecting the first and second coal beds to prevent gases and entrained volatiles from the first coal bed from flowing through the blocked passages into the second coal bed, capturing hot exit gases resulting from the gasification of the second coal bed and directing the hot exit gases to and through the first coal bed to remove volatile material from the first coal bed.

capturing the hot gases and entrained volatiles emanating from the first coal bed and transferring the hot gases and entrained volatiles to the surface, and pumping liquid volatiles to the surface which are released from said first coal bed and flow into the blocked passages.

* * * * *